US008426775B2

(12) United States Patent
Frank

(10) Patent No.: US 8,426,775 B2
(45) Date of Patent: Apr. 23, 2013

(54) MULTI-PURPOSE TOY OVEN

(75) Inventor: Lisa Frank, Tucson, AZ (US)

(73) Assignee: Lisa Frank, Inc., Tucson, AZ (US)

( * ) Notice: Subject to any disclaimer, the term of this patent is extended or adjusted under 35 U.S.C. 154(b) by 217 days.

(21) Appl. No.: 12/795,488

(22) Filed: Jun. 7, 2010

(65) Prior Publication Data

US 2010/0308029 A1 Dec. 9, 2010

Related U.S. Application Data

(60) Provisional application No. 61/184,591, filed on Jun. 5, 2009.

(51) Int. Cl.
*H05B 1/00* (2006.01)
*H05B 3/00* (2006.01)

(52) U.S. Cl.
USPC ..... 219/201; 219/209; 219/391; 219/400

(58) Field of Classification Search ..... 219/201, 219/209, 391, 400
See application file for complete search history.

(56) References Cited

U.S. PATENT DOCUMENTS

| | | | | |
|---|---|---|---|---|
| 3,368,063 | A | 2/1968 | Kuhn | 219/411 |
| 3,783,219 | A | 1/1974 | Tateda | 219/10.55 |
| 4,163,443 | A | 8/1979 | Peterson | 126/197 |
| 4,249,067 | A | 2/1981 | Cummings | 219/392 |
| 4,382,436 | A | 5/1983 | Hager | 219/429 |
| 4,563,573 | A * | 1/1986 | Hartelius et al. | 219/405 |
| 4,772,243 | A | 9/1988 | Zeiss | 446/481 |
| 4,951,652 | A | 8/1990 | Ferrario et al. | 126/200 |
| 5,422,458 | A | 6/1995 | Simmel | 219/391 |
| 5,441,036 | A | 8/1995 | Mikalauskas, II et al. | 126/198 |
| 5,451,745 | A | 9/1995 | Goldberg et al. | 219/413 |
| 5,528,014 | A | 6/1996 | Goldberg et al. | 219/386 |
| 5,954,115 | A | 9/1999 | Lebensfeld et al. | 164/136 |
| 7,182,902 | B2 | 2/2007 | Cziraky | 264/299 |
| 2008/0185373 | A1 | 8/2008 | Elkasevic et al. | 219/394 |
| 2010/0308029 | A1 | 12/2010 | Frank | 219/209 |
| 2011/0186559 | A1 * | 8/2011 | Frank | 219/201 |

OTHER PUBLICATIONS

Decision of Court of Appeals, State of Arizona, filed Oct. 31, 2011 (19 pgs).
http://www.buy.com/prod/easy-bake-meal-oven/q/loc/20269/200779004.html.
International Search Report and Written Opinion, dated Jul. 30, 2010.
Office Action issued in related U.S. Appl. No. 13/086,288, dated Jun. 7, 2012 (13 pgs).
Office Action issued in corresponding U.S. Appl. No. 13/086,288, dated Jul. 17, 2012 (21 pgs).

* cited by examiner

*Primary Examiner* — Theresa T Doan
(74) *Attorney, Agent, or Firm* — Hayes Soloway P.C.

(57) ABSTRACT

The present disclosure provides a toy electric oven including an insulated housing containing a heating chamber, a door that latches to prevent access to the heating chamber while hot, a cooling system with a fan, a timer, and a window for viewing the heating chamber when the door is closed, the window remaining at a safe temperature for touching while the toy electric oven is operating. The window may be a double-paned structure wherein the vapor space between the windows is vented using the cooling fan.

14 Claims, 5 Drawing Sheets

MULTI-PURPOSE TOY OVEN

CROSS REFERENCE TO RELATED APPLICATION

This application claims priority from U.S. Provisional Application Ser. No. 61/184,591, filed Jun. 5, 2009, the contents of which are incorporated herein by reference.

FIELD OF THE INVENTION

The present disclosure relates to toy ovens, and more particularly to multi-purpose toy ovens that operate electrically for heating products designed for use by children. The oven will have particular utility as a baking oven, e.g. for creating decorative items, and will be described in connection with such utility.

BACKGROUND OF THE INVENTION

For many years, toy ovens have been extremely popular products for use by children, enabling a child to cook, on a small scale, various products specially designed for use by children. Such products include craft items, and various toy or play products. Although numerous products have been constructed for use by children in connection with toy ovens and toy ovens have been extremely popular products sold in the marketplace for numerous years, currently available toy ovens continue to suffer from common drawbacks which have been incapable of being fully eliminated.

One of the principal difficulties encountered with toy ovens is insufficient safety features, e.g., preventing injury to a child in connection with the heat and electricity associated with the oven. Although numerous developments have been made in an attempt to provide a safe oven which is inaccessible to a child when hot, such prior art constructions have failed to be fully effective in limiting potential injuries.

While several advances have been made to prevent access to the internal parts of the oven while the temperature of these parts of the oven exceed a safe value, external portions of the oven may still become very hot to the touch and may provide mild to severe burns, the former discouraging use of the appliance and the latter creating liability for its maker.

SUMMARY OF THE INVENTION

A particular point of interest for children is an observation window that allows them to view the cooking process. This specific location is of great curiosity to the child and, unfortunately, is usually the most poorly insulated portion of the appliance. The present disclosure improves upon the prior art by providing a toy electric oven featuring an insulated structure including an observation window that is cool to the touch.

One aspect of the present disclosure provides a toy electric oven, comprising: an insulated housing containing a heating chamber, the insulated housing having an aperture for placing an object in the heating chamber; a door for closing the aperture; a window for viewing the heating chamber when the door is closed, the window remaining at a safe temperature for touching while the toy electric oven is operating; a cooling system including a cooling fan; and a timer. In order to minimize the surface temperature of the window, the window may be comprised of at least two panes, spaced from one another, wherein the cooling fan optionally may be used to force an airstream between the at least two panes.

Another aspect of the present invention provides a method for operating a toy electric oven having an insulated housing with a window comprised of at least two panes, spaced from one another, for observing a heating chamber within, the method comprising: setting a timer, whereupon heat is provided to the heating chamber and a cooling fan optionally is activated, the cooling fan passing an airstream between the at least two panes; and, upon the conclusion of the timer, ceasing to provide heat to the heating chamber and optionally directing the cooling airstream to pass through the heating chamber.

DESCRIPTION OF THE DRAWINGS

Further features and advantages of the present invention will be seen from the following detailed description, taken in conjunction with the accompanying drawings, wherein.

DETAILED DESCRIPTION OF PREFERRED EMBODIMENTS

In the following description, reference is made to the accompanying drawings, which form a part hereof, and in which is shown, by way of illustration, various embodiments of the present disclosure. It is understood that other embodiments may be utilized and changes may be made without departing from the scope of the present invention.

Figure 1:
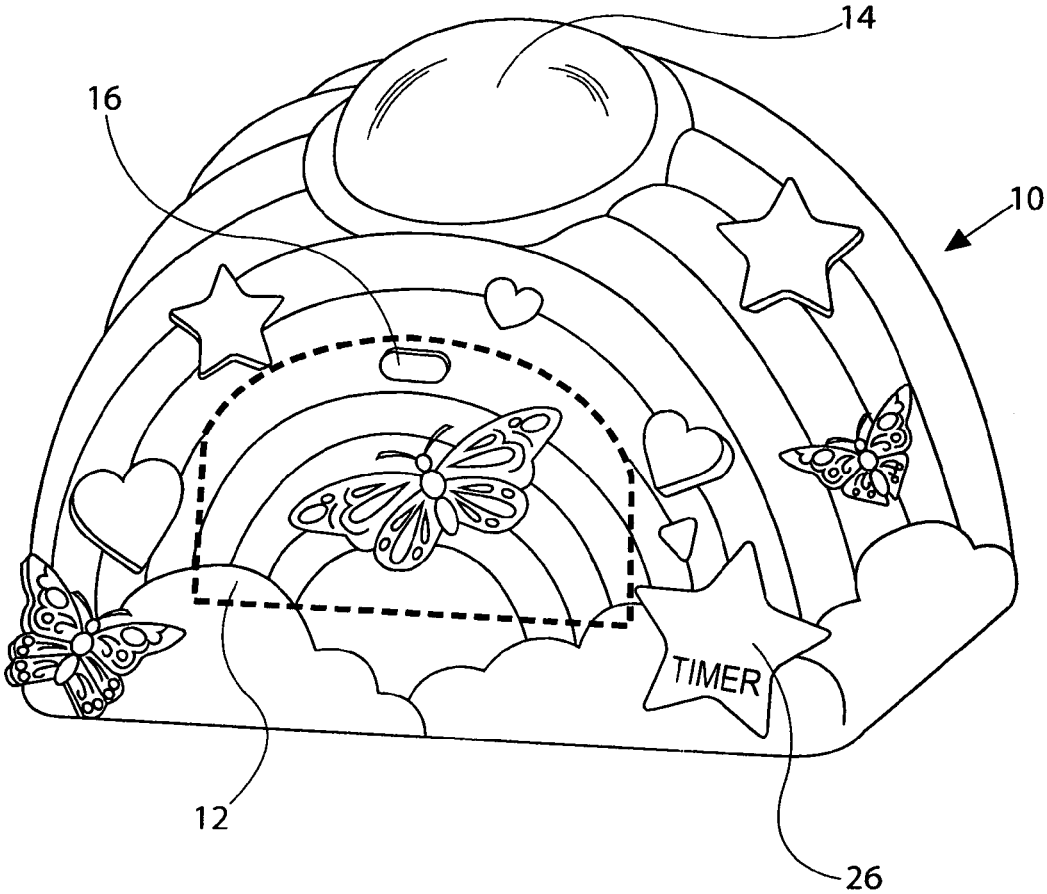
FIG. 1 is an illustration of a toy oven in accordance with the present disclosure.
Figure 2:
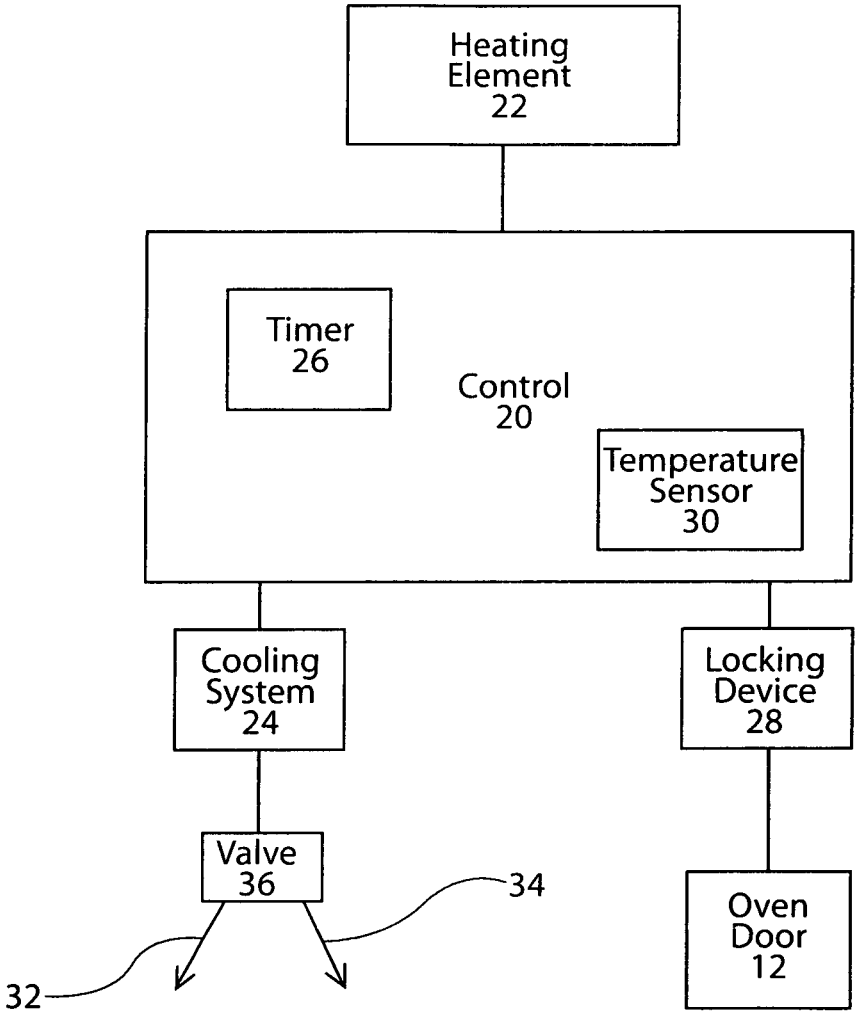
FIG. 2 is a schematic diagram illustrating operation of a toy oven in accordance with the present invention.
Figure 3:
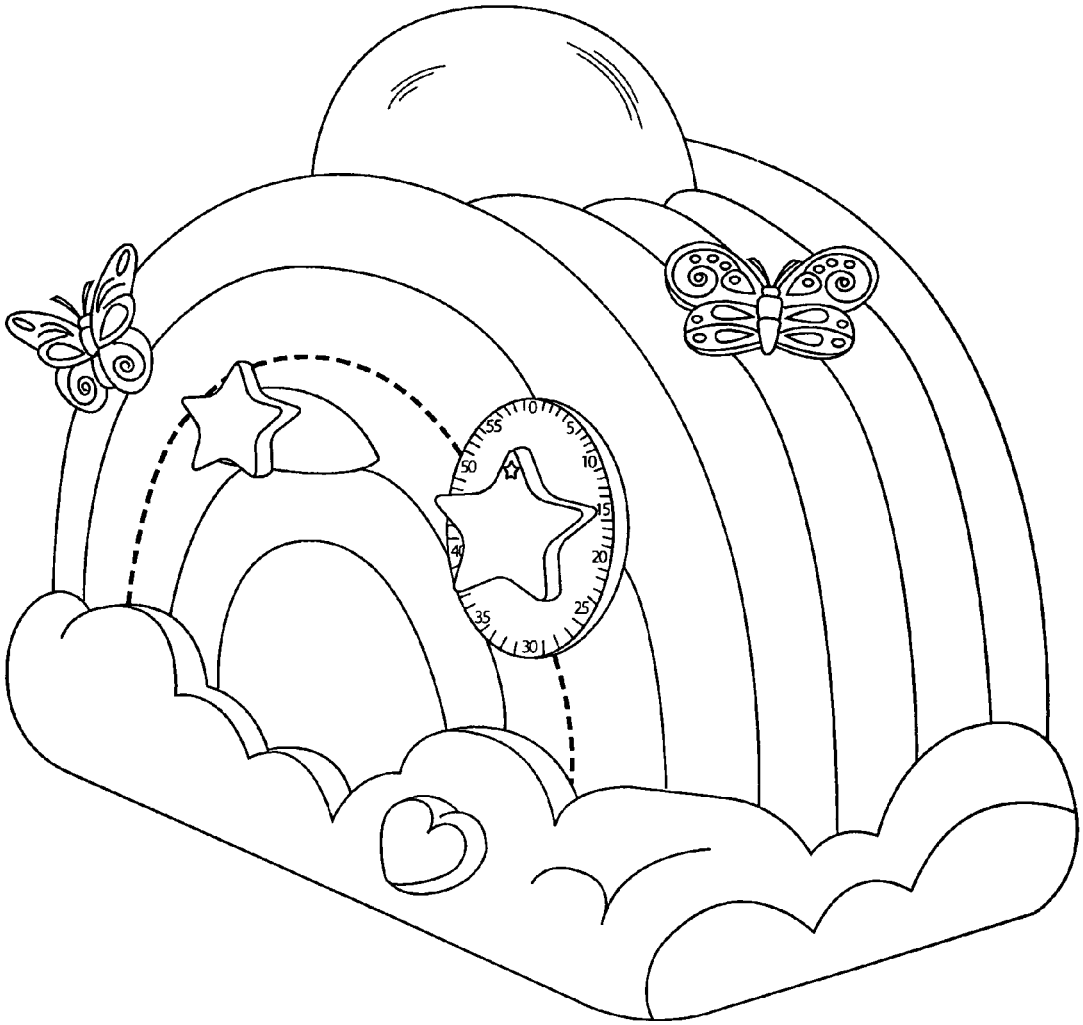
FIGS. 3-5 illustrate an alternative design of my toy oven.
Figure 4:
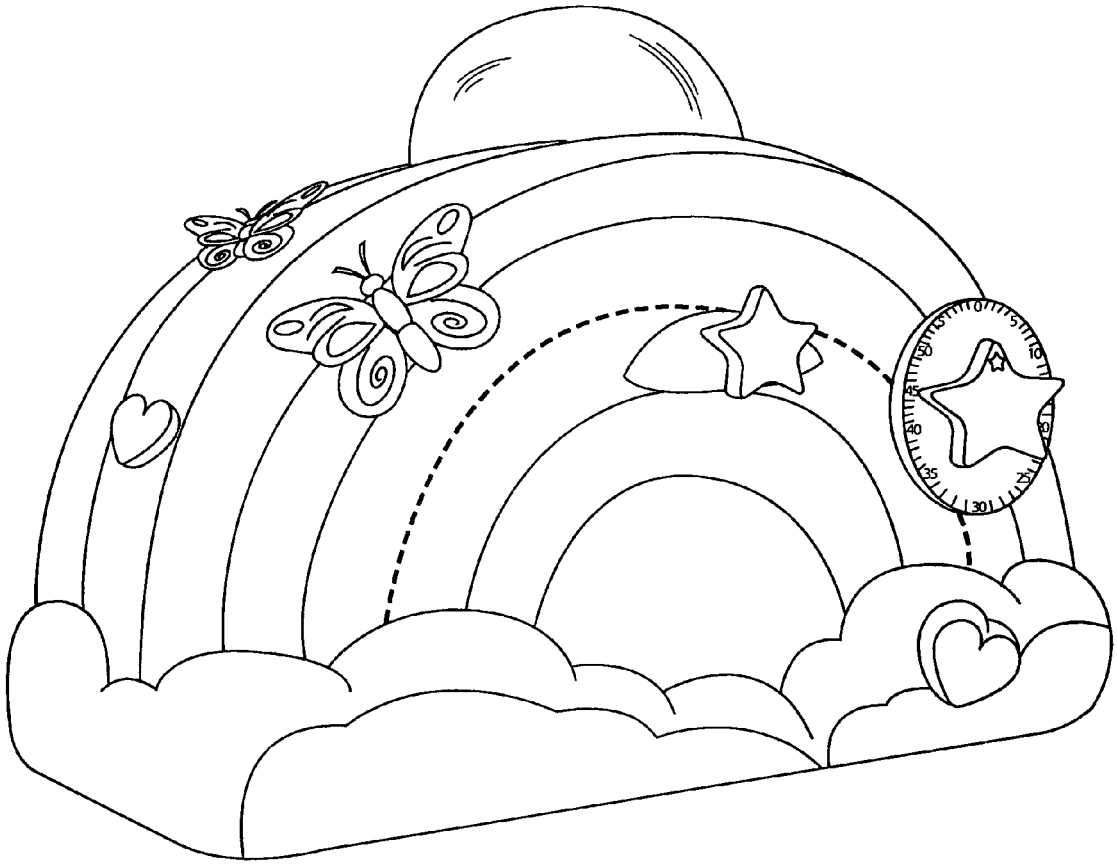
Figure 5:
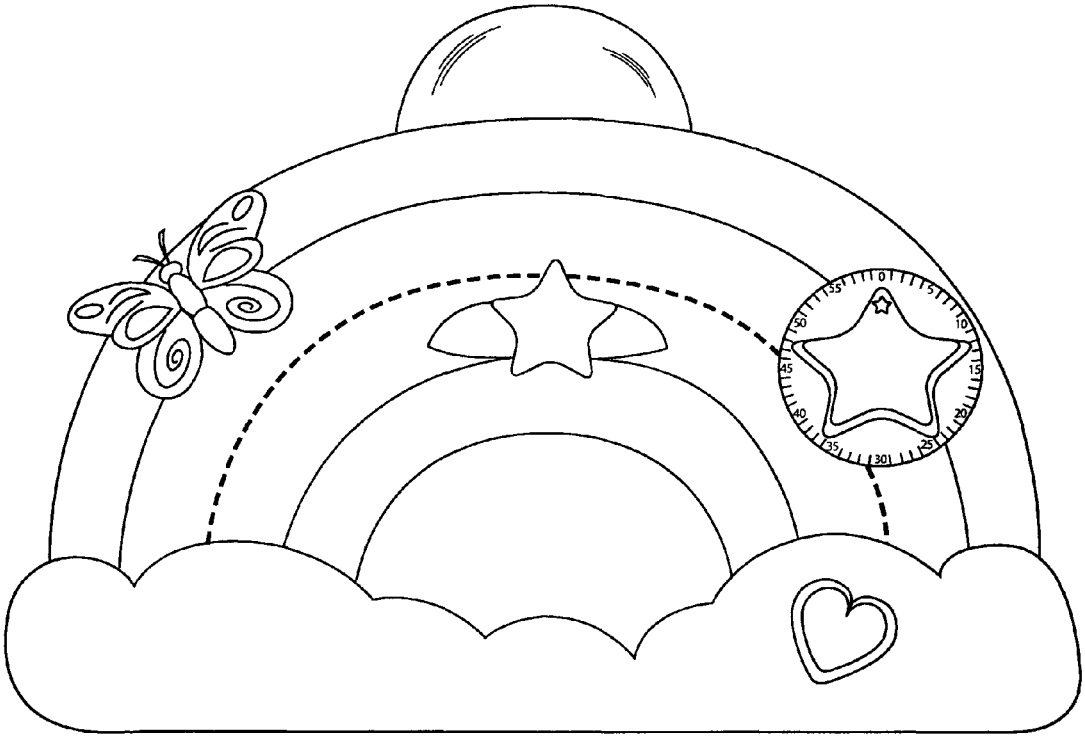

A primary aspect of the present disclosure provides a toy electric oven comprised of an insulated housing 10. Preferably, but not necessarily, the housing may be shaped and bear decorations that are "fun" and attractive to children. Within the insulated housing is a heating chamber (not shown) that may be accessed through an aperture so that an object to be heated may be placed in the heating chamber. It is intended that the aperture and the heating chamber be sized large enough to process three dimensional projects. The aperture is covered by a hingedly mounted door 12 that may be latched. The insulated housing also includes a window 14 for viewing the heating chamber when the door is closed. Referring also to FIG. 2, the oven includes a cool touch handle 16, a control system 20 for operating a heating element 22 as will be discussed below, and a cooling system including a cooling fan 24 is provided so that the object and the heating chamber may be sufficiently cooled, thereby preventing injury. Finally, a timer 26 may be used to initiate operation of the toy electric oven and may also be used to automate some of the other functions of the toy electric oven.

The heating chamber may be heated using an incandescent bulb 22, though other sources of heat, such as an electric resistance heating element, may be used. As a safety feature, the heating chamber may be divided into first and second compartments. The first compartment contains the incandescent bulb 22 and the second compartment is constructed to receive the object to be heated. The first and second compartments may be divided to prevent a child user from accessing the incandescent bulb 22 through the aperture. For example, a grating, a transparent plate, or an optical plate for focusing the light of the incandescent bulb, may be used to separate the first compartment from the second compartment. The incandescent bulb may be changed by removing a panel from the insulated housing that is fastened to the insulated housing, for example, by a plurality of screws. It is intended that the incandescent bulb 22 will be changed only by an adult.

The toy electric oven may also be constructed using a small heating element using a similar configuration to that described above.

The heating chamber may be configured with the surrounding surfaces to be substantially covered with a reflective material to aid in the distribution of heat and to contain the heat within the heating chamber.

The timer 26 of the present disclosure may be used to operate the toy electric oven. The timer may be set, for example, by turning a dial or entering a time value on a digital keypad. In this example, once the timer is set, the door 12 is locked shut by a locking device 28, and heat is provided to the heating chamber for the duration of the set heating time. When the timer concludes, heat is no longer provided and the cooling system 24 is used to cool the heating chamber.

The device may further include a temperature sensor 30 that senses the temperature of the heating chamber. The control 20 is programmed to operate the cooling system 24 to cool the heating chamber until the temperature sensor 30 indicates that the temperature within the heating chamber has fallen below a predetermined value whereupon it is safe for the child to retrieve the object. When this occurs, the locking device 28 is triggered to unlock the oven door 12.

A feature and advantage of the present invention is the provision of a cool-to-the-touch viewing window 14. The window 14 is configured to minimize the surface temperature, so that the child may use the toy electric oven and observe the cooking process without threat of even a minor injury. The window 14 may be kept at near-ambient temperatures while the heating chamber is being heated.

The window may be comprised of at least two panes, forming a vapor space between the at least two panes. The vapor space may be sealed, e.g. to contain a partial vacuum or may be vented to atmosphere. In a preferred embodiment, the cooling fan 24 may be used to force an airstream through the vapor space while the heating chamber is being heated. The insulated housing contains a first path 32 and a second path 34 for an airstream powered by the cooling fan, the first path 32 directing the airstream through the vapor space and the second path directing the airstream through the heating chamber 34. The first path and second path may have a common intake and a common exit, and are separated by a control valve 36. The control valve 36 directs the airstream through the vapor space while heat is being provided to the heating chamber and then directs the airstream through the heating chamber upon conclusion of the heating cycle.

Alternatively, a second fan may be included to perform the separate tasks of cooling the window and the heating chamber.

Because the location of the window 14 is a point of interest to the child, the airstream should be directed away from the window upon exiting the insulated housing.

Forcing an airstream through the vapor space could potentially cause condensate to build up on one or more surfaces. To mitigate this problem, at least one of the panes may have a surface coated with a material that discourages water condensate from collecting.

In order to more effectively keep heat within the heating chamber, one of the panes may have an inner surface (facing the heating chamber) coated with a reflective material that reflects light and heat from within the heating chamber back into the heating chamber.

The toy electric oven of the present disclosure also includes a locking device or latch 28 for the door, so that a user may be prevented from opening the door 12 when the heating chamber is hot. The latch 28 keeps the door 12 from opening when the heating chamber is being heated and remains latched until the cooling system is turned off once the temperature falls to a safe level as sensed by the temperature sensor 30. The toy electric oven of the present disclosure is intended for a variety of uses, including but not limited to, glazing surfaces, melting plastic crystals into forms, shrinking plastic forms, baking clay or dough, fusing two or more plastic items together, fusing beads, baking plaster in molds or baking foods. The toy electric oven may produce various products that include but are not limited to: jewelry and beads, name plates light plate switch covers, picture frames, mobiles, figurines, boxes, plates, cups, bowls magnets, buttons, tiles, suncatchers, and trays.

Another aspect of the present disclosure provides a method for operating a toy electric oven as described above. The method allows the toy electric oven operated through initiating a heating cycle. As the heating cycle starts, the door is locked shut automatically, and, heat is provided to the heating chamber and a cooling fan is activated, the cooling fan passing an airstream between the at least two panes of the window. Upon the conclusion of the heating cycle, heat is no longer delivered to the heating chamber and the airstream is directed to pass through the heating chamber in order to cool the heating chamber and the object that has been baked. The cooling fan continues to cool the heating chamber and the object therein until the temperature of the heating chamber falls below a predetermined value at which time the door latch is unlocked.

The operation of the door and latch may also be controlled by the timer. At the start of the timer, the door is latched to prevent the door from being opened. The door is unlatched a set time after the heating element is turned off. The set time is set at the factory, and is designed to permit the temperature of the heating chamber to fall below a predetermined value. In other words, the door is kept locked until sufficient time elapses to permit the heating chamber to cool to a safe temperature.

It should be emphasized that the above-described embodiments of the present device and process, particularly, and "preferred" embodiments, are merely possible examples of implementations and merely set forth for a clear understanding of the principles of the disclosure. Many different embodiments of the disclosure described herein may be designed and/or fabricated without departing from the spirit and scope of the disclosure. For example, the toy electric oven may further include a delay timer for delaying the function of the timer and other functions that depend on the start of the timer. All these and other such modifications and variations are intended to be included herein within the scope of this disclosure and protected by the following claims. Therefore the scope of the disclosure is not intended to be limited except as indicated in the appended claims.

The invention claimed is:

1. A toy electric oven, comprising: an insulated housing containing a heating chamber, divided into a first compartment and a second compartment, the first compartment containing a heating element, and the second compartment being configured to hold an object to be heated, the insulated housing having an aperture for placing an object in the heating chamber; a door for closing the aperture; a window for viewing the heating chamber when the door is closed, wherein the window is comprised of at least two panes, forming a vapor space between the at least two panes; a cooling system including a powered cooling fan, wherein the cooling fan is arranged to force an airstream through the vapor space while the heating chamber is being heated, wherein the window remains at a safe temperature for touching while the toy electric oven is operating, and wherein the cooling system cools the heating chamber when the heating element is turned off; and a timer.

2. The toy electric oven of claim 1, wherein the heating element comprises an incandescent bulb.

3. The toy electric oven of claim 2, wherein the incandescent bulb is housed in the first chamber and is accessible by removing a panel from an outer surface of the insulated housing, the panel being fastened to the insulated housing with screws.

4. The toy electric oven of claim 1, wherein the oven further includes a timer or a temperature controlled latch, and wherein door is locked by a timer or by a temperature-controlled latch.

5. The toy electric oven of claim 4, wherein the heating element is adapted to begin heating the heating chamber when the timer is set.

6. The toy electric oven of claim 4, wherein the cooling system is adapted to power the cooling fan to begin cooling the heating chamber when the timer is finished.

7. The toy electric oven of claim 6, wherein the insulated housing further includes a temperature sensor that senses a temperature of the heating chamber, and wherein the cooling system is adapted to power the cooling fan to cool the heating chamber until the temperature sensor indicates that the temperature within the heating chamber has fallen below a predetermined value.

8. The toy electric oven of claim 4, wherein the temperature controlled latch includes a temperature sensor for sensing a temperature of the heating chamber, and the latch locks the door against being opened until the temperature sensor senses that the temperature within the heating chamber has fallen below a predetermined value.

9. The toy electric oven of claim 1, wherein the heating chamber is covered at least in part with a reflective surface.

10. The toy electric oven of claim 1, wherein the vapor space is vented.

11. The toy electric oven of claim 1, wherein at least one of the at least two panes has at least one surface coated with a material that discourages condensate formation on the at least one surface.

12. The toy electric oven of claim 1, wherein at least one of the at least two panes has an inner surface coated with a reflective material that reflects light and heat from within the heating chamber back into the heating chamber.

13. A toy electric oven, comprising: an insulated housing containing a heating chamber, the insulated housing having an aperture for placing an object in the heating chamber; a door for closing the aperture; a window for viewing the heating chamber when the door is closed, the window comprised of at least two panes forming a vapor space; and a powered cooling fan; wherein the insulated housing contains a first path and a second path for an airstream powered by the cooling fan, the first path directing the airstream through the vapor space and the second path directing the airstream through the heating chamber, wherein the cooling fan is arranged to force an airstream through the vapor space while the heating chamber is being heated, wherein the window remains at a safe temperature for touching while the toy electric oven is operating.

14. The toy electric oven of claim 13, wherein the first path and second path have a common intake and a common exit, and wherein the first path and the second path are separated by a control valve.

* * * * *